US005647174A

United States Patent [19]

Mattarelli

[11] Patent Number: 5,647,174

[45] Date of Patent: Jul. 15, 1997

[54] COLLAPSIBLE MANTEL ASSEMBLY

[76] Inventor: Anthony Mattarelli, 7207 E. McNichols Rd., Detroit, Mich. 48212

[21] Appl. No.: 298,227

[22] Filed: Aug. 29, 1994

[51] Int. Cl.[6] ..... E04F 19/00; F24B 1/198

[52] U.S. Cl. ..... 52/36.3; 52/584.1; 126/500; 403/373; 411/104

[58] Field of Search ..... 52/36.3, 211, 584.1; 126/500; 403/21, 22, 373; 411/104, 402, 403; 108/89, 90, 153, 154; 312/265

[56] References Cited

U.S. PATENT DOCUMENTS

| | | | |
|---|---|---|---|
| 389,340 | 9/1888 | Thompson | 52/36.3 |
| 420,775 | 2/1890 | Dambach | 52/36.3 |
| 671,145 | 4/1901 | Price | 126/500 X |
| 728,169 | 5/1903 | Holbein | 52/36.3 |
| 827,369 | 7/1906 | Holbein et al. | 52/36.3 |
| 926,910 | 7/1909 | Taylor | 126/500 |
| 2,747,638 | 5/1956 | Cederquist | 411/104 |
| 3,271,914 | 9/1966 | Boyett . | |
| 4,254,596 | 3/1981 | Wright et al. . | |
| 4,945,692 | 8/1990 | Gallier . | |
| 5,119,603 | 6/1992 | Jones . | |

OTHER PUBLICATIONS

Printed Disclosure, No. 23,843 (No Specification); Parker; Oct. 16, 1897; No Country Listed; Found in Class 52–Subclass 36.3.

*Primary Examiner*—Robert Canfield
*Assistant Examiner*—Kevin D. Wilkens
*Attorney, Agent, or Firm*—Gifford, Krass, Groh, Sprinkle, Patmore, Anderson & Citkowski, P.C.

[57] ABSTRACT

A collapsible mantel assembly for use with a fire place opening. A horizontally extending member includes a breast board and a mantel top. A first vertically extending support member and a second vertically extending support member are provided and are located relative first and second ends of the breast board by tongue and groove arrangements extending between the support members and the breast board. Recessed portions are formed in the support members and the breast board and are in alignment upon positioning of the support members and the breast board. A fastener assembly is applied within the recesses at each end of the breast board and secures the support members to the breast board.

3 Claims, 1 Drawing Sheet

COLLAPSIBLE MANTEL ASSEMBLY

BACKGROUND OF THE INVENTION

1. Field of the Invention

The present invention relates generally to fireplace mantels and, more specifically, to a collapsible mantel assembly for surrounding a fireplace opening.

2. Description of the Prior Art

Prefabricated fireplace mantel assemblies are well known in the art. The purpose of such mantel assemblies is to provide a covering for a fireplace opening which is both decorative and functional in nature. The mantel assemblies usually break down into a number of pieces to provide for ease of shipping and are assembled on site by the end user.

U.S. Pat. No. 4,254,596, issued to Wright et al., teaches an assembleable mantelpiece with a mantel, a pair of side members and means for positioning and securing the mantel and pair of side members relative to a fireplace. Wright et al. teaches a series of male pegs on the side members which are received within corresponding female holes formed in a face of the mantel to secure the assembly in place. Additional female holes are formed in a top of the mantel and are received by male pegs of a mantel top support to secure the mantel top.

U.S. Pat. No. 4,945,692, issued to Gallier, is similar in nature to Wright et al. and teaches a three piece mantel assembly in which pegs in a lintel cross member are received within corresponding holes in the top face of upstanding side members. Each of the pieces is formed of a mono-bloc composite material of binder and inorganic fibrous material formed in the shape of a hollow trough.

U.S. Pat. No. 5,119,603, issued to Jones, teaches a fireplace surround assembly capable of being adjusted vertically and horizontally to compensate for imprecisely installed fireplace assemblies. A front piece is adjustable relative to a horizontal board. A pair of vertical supports is affixed to the wall around the fireplace and received the front piece and mantel.

The shortcoming of the prior art is that it does not teach a simplified collapsible mantel assembly having a means for locating a pair of vertically extending side members at opposite ends of a horizontally extending member and a separate fastener means for securing the side members to the extending member, the fastener means being received within adjacent portions of the side members and extending member.

SUMMARY OF THE PRESENT INVENTION

The present invention is a collapsible mantel assembly for surrounding a fireplace opening. The assembly includes a horizontally extending member which is made up of a mantel top and a breast board. Appropriate fasteners are provided for fastening the top to the breast board. A first vertically extending member is positioned relative to a first end of the horizontally extending member and a second vertically extending member is positioned relative to a second end of the horizontally extending member and around the fireplace opening.

A groove portion is formed in the extending member at its first and second ends. The groove portions receive corresponding tongue portions extending from the first and second vertically extending members which cause the vertical members to locate in a desired position relative to the horizontal member.

Mirrored and opposing recessed portions are formed in the side members and the horizontal member and are in alignment with each other upon the side members being located relative to the horizontal member. A spin nut and bolt assembly is inserted into each opposing pair of recessed portions and is tightened to secure the side members to the horizontal member. The recessed portions are formed on the rear faces of the vertical members and the horizontal member and receive the spin nut and bolt assembly such that the rear face of the mantel assembly may be mounted flush against the wall around the fireplace opening.

BRIEF DESCRIPTION OF THE DRAWINGS

Reference will now be made to the attached drawings, when read in combination with the following specification, wherein like reference numerals refer to like parts throughout the several views, and in which.

DESCRIPTION OF THE PREFERRED EMBODIMENT

Figure 1:
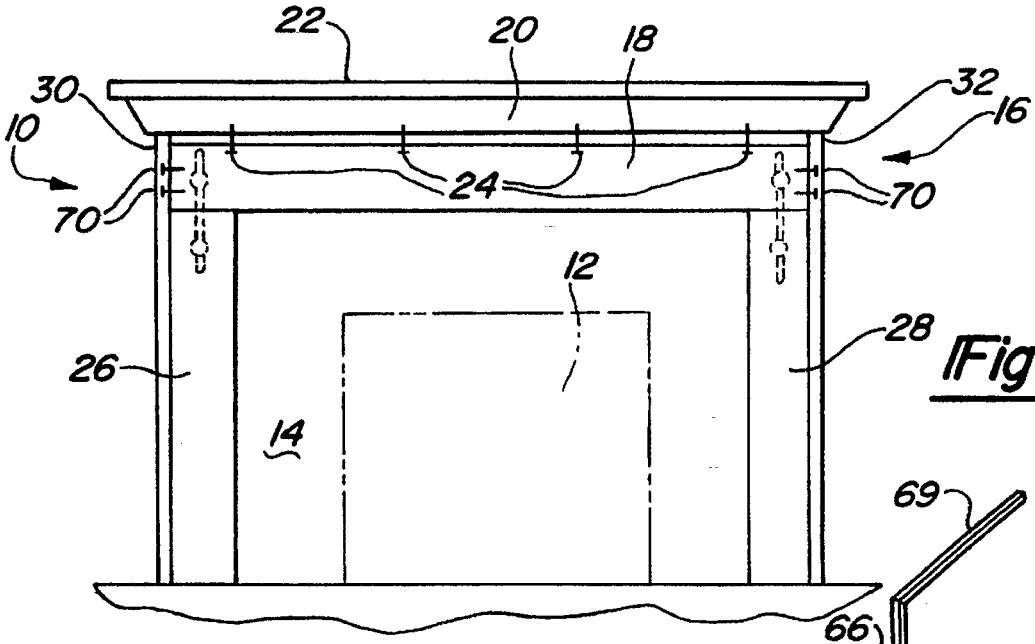
FIG. 1 is a plan view of the mantel assembly according to the present invention in an assembled state.

Referring to FIG. 1, a collapsible mantel assembly 10 for surrounding a fireplace opening is shown in an assembled state. The fireplace opening is designated at 12 and is bordered by a cement or brick surface 14. The mantel assembly 10 is affixed to the brick surface 14 a predetermined distance from the opening 12 by cement screws or other desirable fasteners as may be known in the art. The pieces of the mantel assembly are preferably constructed of a heavy duty wood material, but may also be made of any desirable ceramic or other heat resistant material.

The mantel assembly 10 includes a horizontally extending member 16. The horizontally extending member 16 is made up of a breast board 18 and a top board 20. The top board 20 has a planar upper surface 22 and is secured to the breast board 18 by wood screws 24 or the like. The breast board 18 is an elongated member having a front face and a rear face which are spaced apart so as to define a predetermined thickness.

A first vertically extending support member 26 and a second vertically extending support member 28 are provided and are arranged at opposite ends of the breast board 18 of the horizontal member 16. The first support member 26 is provided at a first end 30 of the horizontal member 16 and the second support member 28 is provided at a second end 32.

Figure 4:
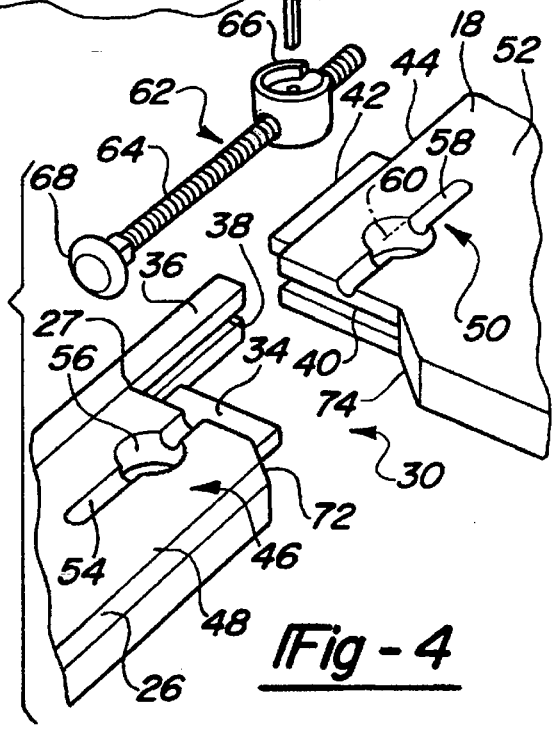
FIG. 4 is an exploded view similar to that shown in FIG. 2 and also showing an alternately configured side member and horizontal member according to the present invention.

Referring further to FIG. 4, a sectional view of the support member 26 and the breast board 18 at the first end 30 is shown. The support member includes a first tongue portion 34 substantially rectangular in shape and projecting upwardly from the side member 26. A side wing 36 also extends upwardly from the support member 26 along an outer edge 27 of the member 26 and is defined by a first extending groove 38 in its inner face.

The breast board 18 has a second inwardly grooved portion 40 opposite the tongue portion 34 of the support member 26. A second tongue portion 42 projects laterally from an edge 44 of the breast board 18 and is in alignment with the extending groove 38 of the vertical side wing 36. The first tongue portion 34 is received within the grooved portion 40 and the vertically extending groove portion 38 is received within the second tongue portion 42 to locate the support member 26 in a desired position relative to the breast board 18.

Figure 2:
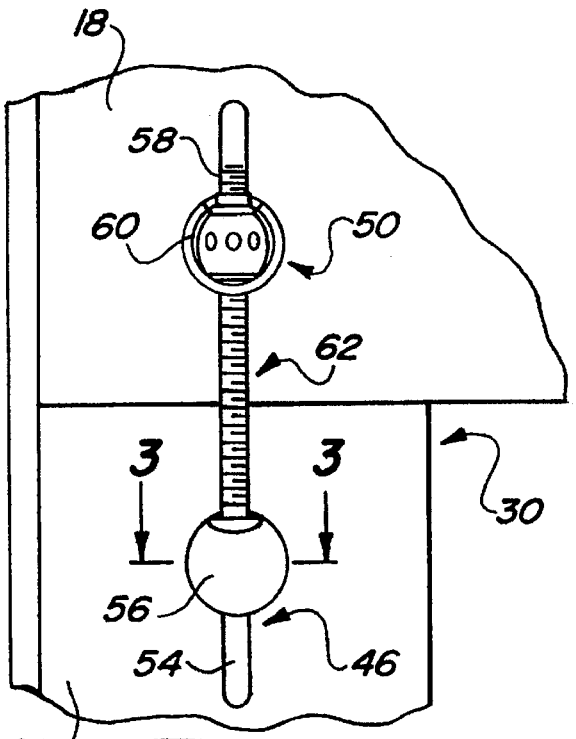
FIG. 2 is a sectional view of the fastening means of the mantel assembly according to the present invention.

Referring again to FIG. 4, and also to FIG. 2, a first recessed portion 46 is formed into a rear face 48 of the support member 26 and a second recessed portion 50 is formed into a rear face 52 of the breast board 18 at its first end 30. The first recessed portion 46 includes an elongated slotted portion 54 and an enlarged semi-spherical portion 56 at a point along the slotted portion 54. Likewise, the second recessed portion 50 includes an elongated slotted portion 58 and an enlarged semi-spherical portion 60 at a point along the slotted portion 58.

Figure 3:
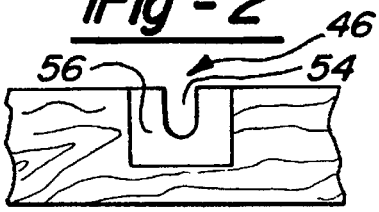
FIG. 3 is a cut-away view taken along line 3—3 of FIG. 2 and showing the recessed portion in the first vertical side member for receiving the fastening means.

Referring to FIG. 3, a cut-away view of the first recessed portion 46 is shown. The elongated slotted portion 54 extends up through and beyond the enlarged semi-spherical portion 56. The cut-away view of FIG. 3 indicates a two-dimensional square cross section of the enlarged portion 56, however it is generally counterbored in shape and extends inwardly in the side member 26 relative to the rear face 48. The second recessed portion 50 is identical in cross-section to the first recessed portion 46.

The elongated slotted portion 54 of the first recessed portion 46 is positioned in alignment with the elongated slotted portion 58 of the second recessed portion 50 when the support member 26 is located relative to the breast board 18. A fastener assembly 62 is provided and is preferably a spin nut assembly. The spin nut assembly 62 includes a bolt member 64 and a rotatable spin nut 66 mounted to the bolt member. A head 68 at one end of the bolt member 64 is inserted within the enlarged portion 56 of recessed portion 46. The spin nut 66 is likewise inserted within the enlarged portion 60 of opposed recessed portion 50. An allen wrench 69 is inserted within the spin nut and rotates the spin nut in a tightening direction until the support member 26 is secured to the breast board 18.

In operation, the first support member 26 and the second support member 28 are located respectively at the first end and the second end of the breast board 18 by aligning the first and second pairs of tongue and groove portions extending from the support members and the breast board. The positioning of the support members relative to the breast board also causes the slotted portions of the opposing recessed portions to be in alignment. The spin nut assemblies are then inserted within the recessed portions and are tightened to secure the support members to the breast board. The spin nut assemblies are contained within the recessed portions so that the rear faces of the breast board and support members remain planar and may be mounted flush against the fireplace wall. The mantel top is then secured to the breast board by the wood screws. Finally, a set of four finish nails 70 are applied to secure the side wings of the support members to the sides of the breast board.

While only a description of the connection between the first support member and the breast board has been made, it is understood that the second support member secures the second end of the breast board in an identical manner.

Also, with reference to FIG. 4, the first support member 26 can have an inwardly angled edge 72 and the opposing first end of the breast board 18 can have an opposite and conforming angled edge 74. The angling of the edges 72 and 74 can assist in the location of the opposing members prior to fastening. However, the angling of the edges of the members is not necessary to practice the present invention, as is shown by the parallel edges of the support member and breast board in FIG. 2.

Having described my invention, additional embodiments will become apparent to those skilled in the art to which it pertains without deviating from the scope of the appended claims.

I claim:

1. A collapsible mantel assembly for surrounding a fireplace opening, comprising:

a horizontally extending member having a front face, a rear face, a first end, a second end, a planar top surface and a bottom surface;

a first vertically extending support member and a second vertically extending support member, each of said first and second vertical support members being constructed of an elongated body having a front face, a rear face, a predetermined thickness and including a top end and a bottom end;

an elongated first tongue portion extending axially from said top end of each of said first and second support members;

an elongated first grooved portion being recessed within said bottom surface of said horizontally extending member proximate each of said first and second ends, said first tongue portions corresponding in shape with said first grooved portions and being received within said first grooved portions;

an elongated second tongue portion extending axially from each end of each of said horizontally extending member;

an elongated second grooved portion being recessed within said end of each of said support members, said second tongue portions corresponding in shape with said second grooved portions and being received within said second grooved portions;

whereby said tongue and groove portions provide means for positioning said first vertically extending member at said first end of said horizontally extending member and said second vertically extending support member at said second end of said horizontally extending member;

fastener means comprising a first counterbore portion formed within said rear face of each of said first and second support members proximate said top ends and a second counterbore portion formed within said rear face of said horizontally extending member at each of said first and second ends, said first and second counterbore portions each further including an interconnecting and slot shaped elongated portion and an enlarged recessed circular end; and said fastener means further comprising a pair of spin nut assemblies, each spin nut assembly having a first end inserted within each of said circular ends of said first counterbored portions, a second end inserted within each of said second ends of said second counterbored portions and an interconnecting stem portion inserted within said interconnecting slot shaped elongated portion;

said fastener means being located in proximity to and cooperating with said positioning means so that, upon positioning of said first and second vertical support members relative to said horizontal member, said spin nut assemblies are inserted within said recessed portions on said rear face of said horizontal member and each of said first and second support members, said spin nut assemblies being tightened to fasten said first vertically extending support member at said first end and said second vertically extending support member at said second end of said horizontally extending member to quickly and conveniently assemble said collapsible mantel assembly for placement against a boundary wall of the fireplace opening.

2. The collapsible mantel assembly according to claim 1, said horizontal member comprising a mantel top and a breast board, said mantel top being secured to said breast board by wood screws.

3. The collapsible mantel assembly according to claim 1, wherein said positioning means further comprises angled edge portions along said first support member and said second support member and corresponding angled edge portions along said horizontally extending member at said first end and said second end.

* * * * *